US009788379B2

(12) United States Patent
Loveridge et al.

(10) Patent No.: US 9,788,379 B2
(45) Date of Patent: Oct. 10, 2017

(54) DEEP DIMMING OF AN LED-BASED ILLUMINATION DEVICE

(71) Applicant: Xicato, Inc., San Jose, CA (US)

(72) Inventors: Barry Mark Loveridge, San Jose, CA (US); Jeffrey P. Hushley, Kailua, HI (US)

(73) Assignee: Xicato, Inc., San Jose, CA (US)

( * ) Notice: Subject to any disclaimer, the term of this patent is extended or adjusted under 35 U.S.C. 154(b) by 0 days.

(21) Appl. No.: 14/670,342

(22) Filed: Mar. 26, 2015

(65) Prior Publication Data

US 2015/0282270 A1 Oct. 1, 2015

Related U.S. Application Data

(60) Provisional application No. 61/972,122, filed on Mar. 28, 2014.

(51) Int. Cl.
*H05B 33/08* (2006.01)
*H05B 37/02* (2006.01)

(52) U.S. Cl.
CPC ..... *H05B 33/0845* (2013.01); *H05B 33/0806* (2013.01); *H05B 33/0815* (2013.01); *H05B 37/02* (2013.01)

(58) Field of Classification Search
CPC H02M 1/08; H02M 3/33569; H05B 33/0815; H05B 33/0839; H05B 33/0851;
(Continued)

(56) References Cited

U.S. PATENT DOCUMENTS 4,344,036 A * 8/1982 Dakroub ..... G06F 1/08 327/115
5,959,316 A 9/1999 Lowery
(Continued)

FOREIGN PATENT DOCUMENTS

EP 2257130 A1 12/2010
EP 2603060 A1 6/2013
(Continued)

OTHER PUBLICATIONS

International Search Report and Written Opinion mailed on Jul. 8, 2015 for International Application No. PCT/US2015/023154 filed on Mar. 27, 2015 by Xicato, Inc., 12 pages.

*Primary Examiner* — Alexander H Taningco
*Assistant Examiner* — Renan Luque
(74) *Attorney, Agent, or Firm* — Silicon Valley Patent Group LLP

(57) ABSTRACT

An LED based illumination device is dimmed by controlling an average current supplied to the LED based illumination device. The currently supplied to the LED may be supplied by an LED driver that is in communication with a dimming control engine. The dimming control engine may receive an indication of a desired average current level. The dimming control engine controls the LED driver to periodically switch a current supplied to an LED of the LED based illumination device from a high state to a low state over a switching period, wherein both a duration of the switching period is adjusted and a ratio of a time in the high state to a time in the low state is adjusted as the average current supplied to the LED based illumination device transitions from a first average current level to the desired average current level.

16 Claims, 9 Drawing Sheets

(58) Field of Classification Search
CPC ..... H05B 33/0818; H05B 33/0866; H05B 33/086; H05B 33/0848; H05B 33/0872; H05B 37/02; H05B 33/0803; H05B 33/0827; H05B 33/0824
USPC .... 315/291, 297, 307, 185 R, 308, 312, 112, 315/113, 121, 129
See application file for complete search history.

(56) References Cited

U.S. PATENT DOCUMENTS 6,351,069 B1 2/2002 Lowery et al.
6,504,301 B1 1/2003 Lowery
6,586,882 B1 7/2003 Harbers
6,600,175 B1 7/2003 Baretz et al.
6,680,569 B2 1/2004 Mueller-Mach et al.
6,812,500 B2 11/2004 Reeh et al.
7,126,162 B2 10/2006 Reeh et al.
7,250,715 B2 7/2007 Mueller et al.
7,479,662 B2 1/2009 Soules et al.
7,564,180 B2 7/2009 Brandes
7,614,759 B2 11/2009 Negley
7,629,621 B2 12/2009 Reeh et al.
2007/0081336 A1 4/2007 Bierhuizen et al.
2007/0262733 A1* 11/2007 Lin ..... G09G 3/3406 315/312
2008/0079407 A1* 4/2008 Shimada ..... H03K 7/08 323/283
2010/0156319 A1* 6/2010 Melanson ..... H05B 33/0839 315/297
2010/0327766 A1* 12/2010 Recker ..... H02J 9/02 315/291
2011/0193484 A1 8/2011 Harbers et al.
2012/0032661 A1 2/2012 Nakamura
2012/0319585 A1* 12/2012 Shteynberg ..... H05B 33/0818 315/112
2013/0147356 A1* 6/2013 Masumoto ..... H05B 37/02 315/121
2013/0293134 A1* 11/2013 Ishikita ..... H05B 33/0839 315/210
2014/0009085 A1* 1/2014 Veskovic ..... H05B 33/08 315/307
2014/0354170 A1* 12/2014 Gredler ..... H05B 33/0815 315/224
2015/0061624 A1* 3/2015 Lalithambika ..... H02M 3/156 323/282
2015/0130372 A1* 5/2015 Chitta ..... H02M 1/08 315/307

FOREIGN PATENT DOCUMENTS

EP 2640165 A1 9/2013
WO WO 2009/010916 A2 1/2009
WO WO 2011/135505 A1 11/2011

* cited by examiner

DEEP DIMMING OF AN LED-BASED ILLUMINATION DEVICE

CROSS REFERENCE TO RELATED APPLICATIONS

This application claims priority under 35 USC 119 to U.S. Provisional Application No. 61/972,122, filed Mar. 28, 2014, which is incorporated by reference herein in its entirety.

TECHNICAL FIELD

The described embodiments relate to illumination modules that include Light Emitting Diodes (LEDs).

BACKGROUND

The use of light emitting diodes in general lighting is still limited due to limitations in light output level or flux generated by the illumination devices. Illumination devices that use LEDs also typically suffer from poor color quality characterized by color point instability. The color point instability varies over time as well as from part to part. Poor color quality is also characterized by poor color rendering, which is due to the spectrum produced by the LED light sources having bands with no or little power. Further, illumination devices that use LEDs typically have spatial and/or angular variations in the color. Additionally, illumination devices that use LEDs are expensive due to, among other things, the necessity of required color control electronics and/or sensors to maintain the color point of the light source or using only a small selection of produced LEDs that meet the color and/or flux requirements for the application.

Illumination devices that use LEDs also typically suffer from poor dimming characteristics, particularly at low light output levels. This is commonly referred to as deep dimming. Constant current reduction (CCR) dimming control schemes are limited in their ability to achieve deep dimming due to LED driver limitations. In addition, operation of LEDs at current levels below approximately 10% of their rated current level may lead to operational and reliability difficulties. Thus, constant current reduction dimming control schemes are typically limited to no less than 10% of the normal, undimmed light output. Digital dimming techniques are also employed. In one example, pulse width modulated (PWM) dimming control schemes are employed. In a pulse width modulated control scheme, the current supplied to the LED is switched on and off at a fixed frequency, and the current output is modulated by adjusting the duty cycle of the on pulse. At dimming levels below, for example, 5%, pulse width modulated dimming schemes typically exhibit unsmooth transitions between each digital dimming step. At very small duty cycles, limitations in digital resolution cause relatively large jumps in duty cycle at each digital dimming step. For example, when adjusting the duty cycle by 1% to dim a light from 100% of the full intensity to 99% of the full intensity, the relative change in intensity is small. However, when adjusting the duty cycle by 1% to dim a light from 10% of the full intensity to 9% of the full intensity, the relative change in intensity is very large, 10%. These relatively large jumps manifest themselves as jumps in light output that are clearly visible when the light output is changed at low light levels.

In order for PWM to produce smooth transitions between each digital dimming step at low intensities, a large number of pulses are required in a period. To produce a large number of pulses, however, requires either high clock frequencies, which increases costs, or a large PWM period, which results in an undesirable visible flicker.

Consequently, improvements to illumination device that uses light emitting diodes as the light source are desired. In particular, improvements in deep dimming performance are desired.

SUMMARY

An LED based illumination device is dimmed by controlling an average current supplied to the LED based illumination device. The currently supplied to the LED may be supplied by an LED driver that is in communication with a dimming control engine. The dimming control engine may receive an indication of a desired average current level. The dimming control engine controls the LED driver to periodically switch a current supplied to an LED of the LED based illumination device from a high state to a low state over a switching period, wherein both a duration of the switching period is adjusted and a ratio of a time in the high state to a time in the low state is adjusted as the average current supplied to the LED based illumination device transitions from a first average current level to the desired average current level.

In one implementation, a method of controlling an average current supplied to an LED based illumination device includes receiving an indication of a desired average current level that differs from a first average current level supplied to an LED of the LED based illumination device, wherein a current supplied to the LED of the LED based illumination device is periodically switched from a high state to a low state over a switching period; and adjusting both a duration of the switching period and a ratio of a time in the high state to a time in the low state as the average current supplied to the LED of the LED based illumination device transitions from the first average current level to the desired average current level.

In one implementation, an LED based illumination device includes at least one light emitting diode (LED); a LED driver coupled to the LED, the LED driver configured to supply a current to the LED based on a digital control signal received by the LED driver; and a dimming control engine configured to communicate the digital control signal to the LED driver, the dimming control engine, comprising: an amount of electronic circuitry configured to generate the digital control signal, wherein the digital control signal periodically switches between a high state and a low state, and wherein both a duration of a switching period and a ratio of a time in the high state to a time in the low state are adjusted as an average current supplied to the LED based illumination device transitions from a first average current level to a desired average current level.

In one implementation, a dimming control engine includes a microprocessor configured to receive an indication of a desired average current level supplied to an LED based illumination device; an amount of electronic circuitry configured to generate a digital control signal that periodically switches between a high state and a low state, and wherein both a duration of a switching period and a ratio of a time in the high state to a time in the low state are adjusted as an average current supplied to the LED based illumination device transitions from a first average current level to the desired average current level.

BRIEF DESCRIPTION OF THE DRAWINGS

The accompanying drawings, where like numerals indicate like components, illustrate embodiments of the invention.

DETAILED DESCRIPTION

Reference will now be made in detail to background examples and some embodiments of the invention, examples of which are illustrated in the accompanying drawings.

Figure 1:
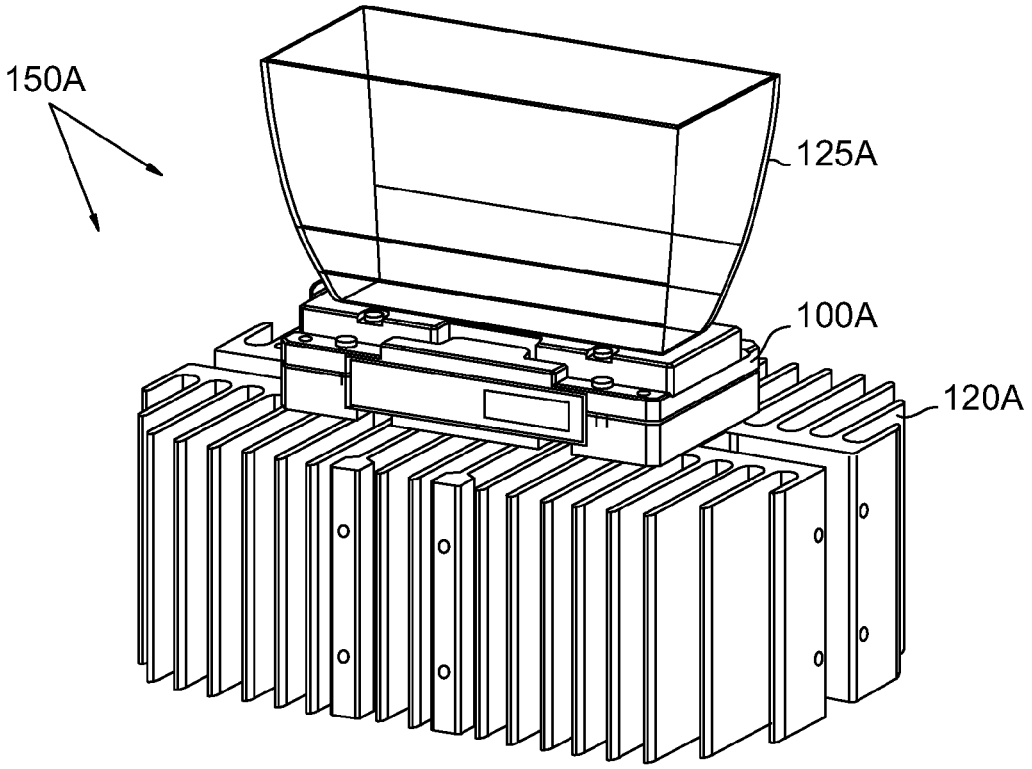
FIGS. 1, 2, and 3 illustrate exemplary luminaires, including an illumination device, reflector, and light fixture.
Figure 2:
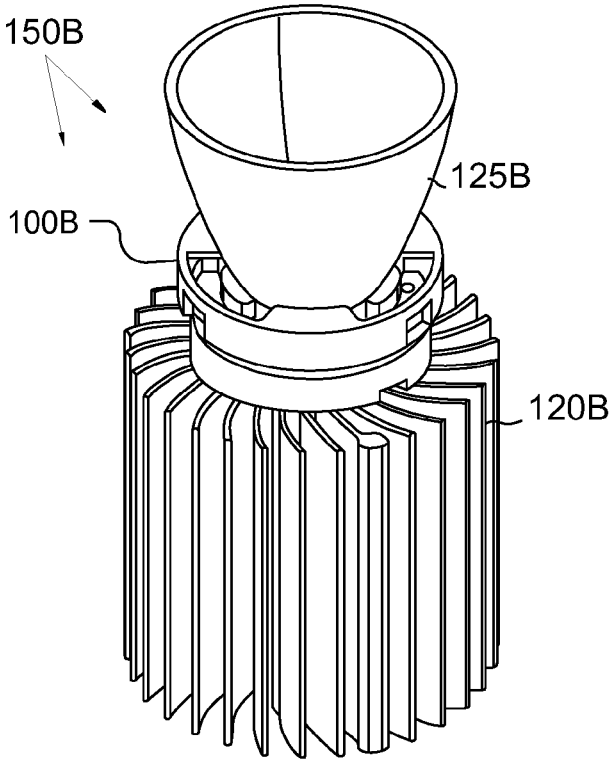
Figure 3:
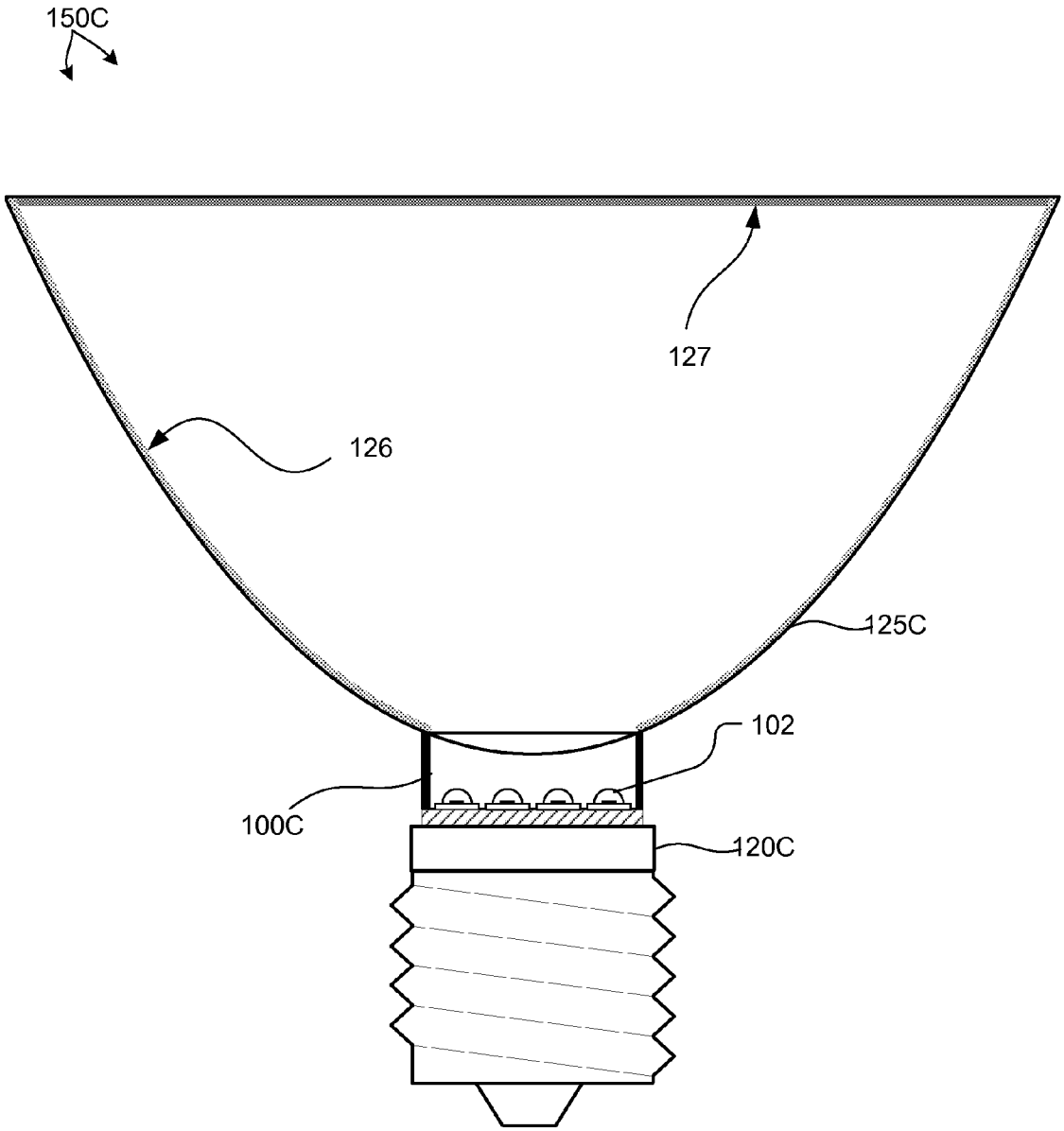

FIGS. 1, 2, and 3 illustrate three exemplary luminaires, respectively all labeled 150A, 150B, and 150C (sometimes collectively or generally referred to as luminaire 150). The luminaire 150A illustrated in FIG. 1 includes an illumination device 100A with a rectangular form factor. The luminaire 150B illustrated in FIG. 2 includes an illumination device 100B with a circular form factor. The luminaire 150C illustrated in FIG. 3 includes an illumination device 100C integrated into a retrofit lamp device. These examples are for illustrative purposes. Examples of illumination modules of general polygonal and elliptical shapes may also be contemplated. Luminaire 150 includes illumination device 100, reflector 125, and light fixture 120. FIG. 1 illustrates luminaire 150A with an LED based illumination device 100A, reflector 125A, and light fixture 120A. FIG. 2 illustrates luminaire 150B with an LED based illumination device 100B, reflector 125B, and light fixture 120B. FIG. 3 illustrates luminaire 150C with an LED based illumination device 100C, reflector 125C, and light fixture 120C. For the sake of simplicity, LED based illumination modules 100A, 100B, and 100C may be collectively referred to as illumination device 100, reflectors 125A, 125B, and 125C may be collectively referred to as reflector 125, and light fixtures 120A, 120B, and 120C may be collectively referred to as light fixture 120. As illustrated in FIG. 3, the LED based illumination device 100 includes LEDs 102. As depicted, light fixture 120 includes a heat sink capability, and therefore may be sometimes referred to as heat sink 120. However, light fixture 120 may include other structural and decorative elements (not shown). Reflector 125 is mounted to illumination device 100 to collimate or deflect light emitted from illumination device 100. The reflector 125 may be made from a thermally conductive material, such as a material that includes aluminum or copper and may be thermally coupled to illumination device 100. Heat flows by conduction through illumination device 100 and the thermally conductive reflector 125. Heat also flows via thermal convection over the reflector 125. Reflector 125 may be a compound parabolic concentrator, where the concentrator is constructed of or coated with a highly reflecting material. Optical elements, such as a diffuser or reflector 125 may be removably coupled to illumination device 100, e.g., by means of threads, a clamp, a twist-lock mechanism, or other appropriate arrangement. As illustrated in FIG. 3, the reflector 125 may include sidewalls 126 and a window 127 that are optionally coated, e.g., with a wavelength converting material, diffusing material or any other desired material.

As depicted in FIGS. 1, 2, and 3, illumination device 100 is mounted to heat sink 120. Heat sink 120 may be made from a thermally conductive material, such as a material that includes aluminum or copper and may be thermally coupled to illumination device 100. Heat flows by conduction through illumination device 100 and the thermally conductive heat sink 120. Heat also flows via thermal convection over heat sink 120. Illumination device 100 may be attached to heat sink 120 by way of screw threads to clamp the illumination device 100 to the heat sink 120. To facilitate easy removal and replacement of illumination device 100, illumination device 100 may be removably coupled to heat sink 120, e.g., by means of a clamp mechanism, a twist-lock mechanism, or other appropriate arrangement. Illumination device 100 includes at least one thermally conductive surface that is thermally coupled to heat sink 120, e.g., directly or using thermal grease, thermal tape, thermal pads, or thermal epoxy. For adequate cooling of the LEDs, a thermal contact area of at least 50 square millimeters, but preferably 100 square millimeters should be used per one watt of electrical energy flow into the LEDs on the board. For example, in the case when 20 LEDs are used, a 1000 to 2000 square millimeter heatsink contact area should be used. Using a larger heat sink 120 may permit the LEDs 102 to be driven at higher power, and also allows for different heat sink designs. For example, some designs may exhibit a cooling capacity that is less dependent on the orientation of the heat sink. In addition, fans or other solutions for forced cooling may be used to remove the heat from the device. The bottom heat sink may include an aperture so that electrical connections can be made to the illumination device 100.

Figure 4:
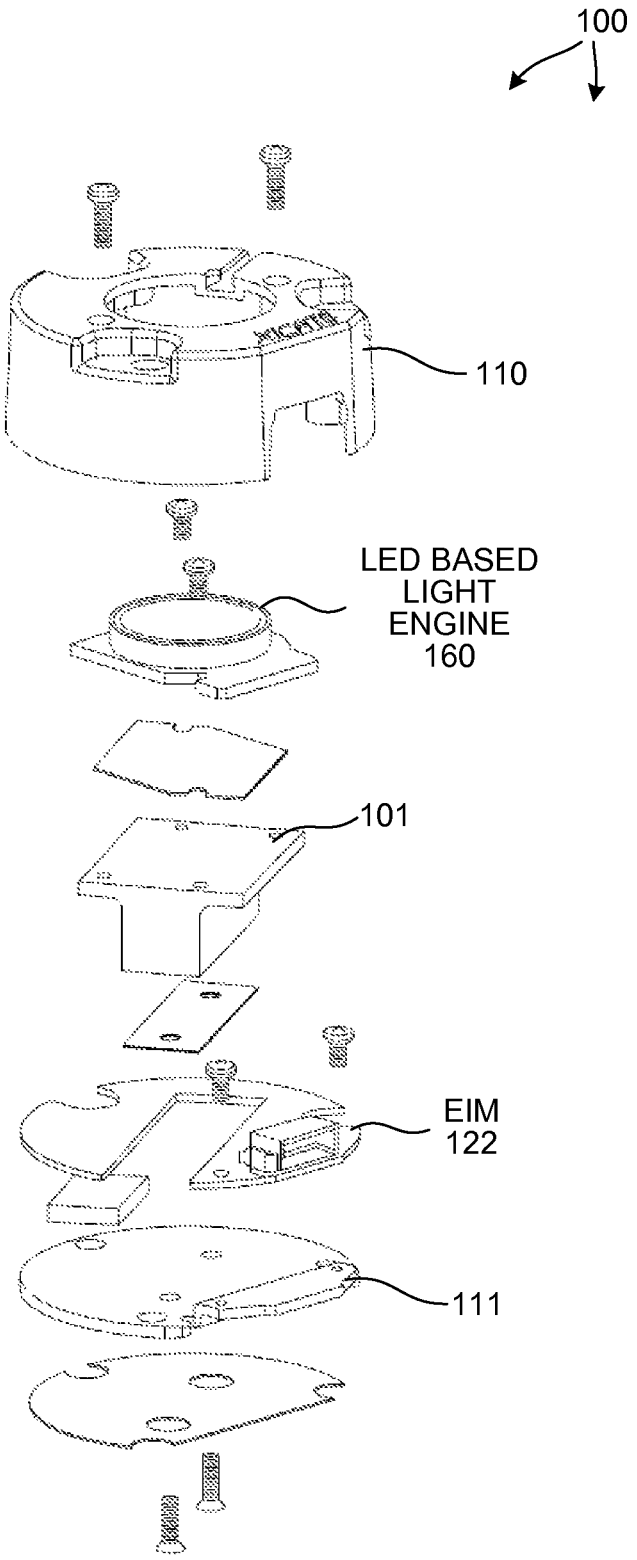
FIG. 4 shows an exploded view illustrating components of LED based illumination device as depicted in FIG. 2.

FIG. 4 shows an exploded view illustrating components of LED based illumination device 100 as depicted in FIG. 2. It should be understood that as defined herein an LED based illumination device is not an LED, but is an LED light source or fixture or component part of an LED light source or fixture. LED based illumination device 100 includes an LED based light engine 160 configured to generate an amount of light. LED based light engine 160 is coupled to a mounting base 101 to promote heat extraction from LED based light engine 160. Optionally, an electronic interface module (EIM) 122 is shaped to fit around mounting base 101. LED based light engine 160 and mounting base 101 are enclosed between a lower mounting plate 111 and an upper housing 110. An optional reflector retainer (not shown) is coupled to upper housing 110. The reflector retainer is configured to facilitate attachment of different reflectors to the LED based illumination device 100.

Figure 5:
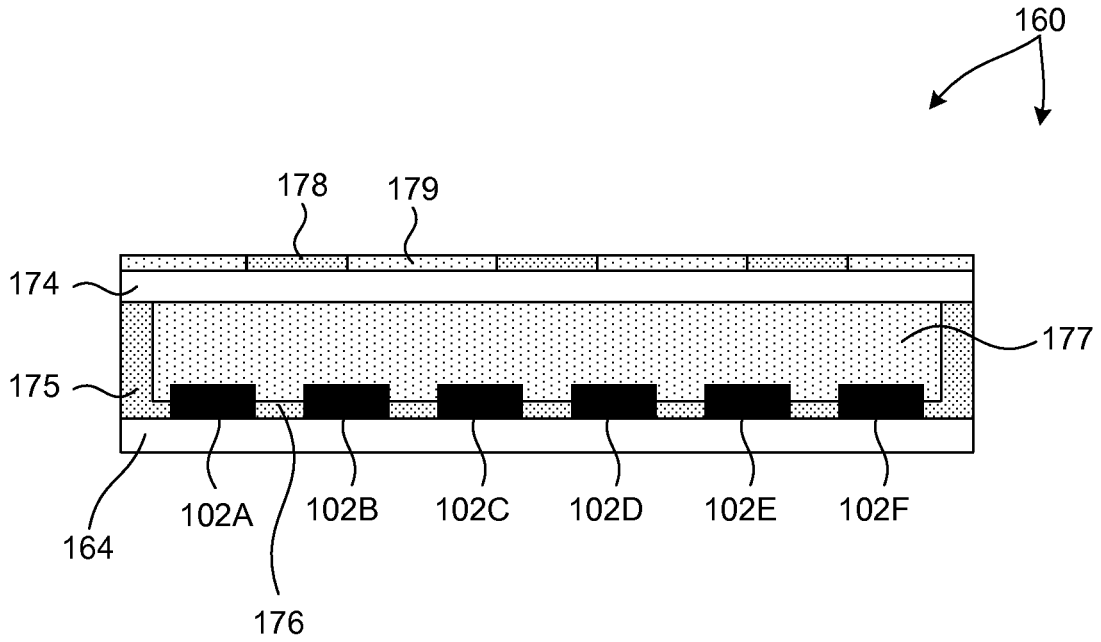
FIG. 5 is illustrative of an LED based light engine that may be used in the LED based illumination device.

FIG. 5 is illustrative of LED based light engine 160 in one embodiment. LED based light engine 160 includes one or more LED die or packaged LEDs and a mounting board to which LED die or packaged LEDs are attached. In addition, LED based light engine 160 includes one or more transmissive elements (e.g., windows or sidewalls) coated or impregnated with one or more wavelength converting materials to achieve light emission at a desired color point.

As illustrated in FIG. 5, LED based light engine 160 includes a number of LEDs 102A-F (collectively referred to as LEDs 102) mounted to mounting board 164 in a chip on board (COB) configuration. The spaces between each LED are filled with a reflective material 176 (e.g., a white silicone material). In addition, a dam of reflective material 175 surrounds the LEDs 102 and supports transmissive element 174, sometimes referred to as transmissive plate 174. The space between LEDs 102 and transmissive plate 174 is filled with an encapsulating material 177 (e.g., silicone) to promote light extraction from LEDs 102 and to separate LEDs 102 from the environment. In the depicted embodiment, the dam of reflective material 175 is both the thermally conductive structure that conducts heat from transmissive plate 174 to LED mounting board 164 and the optically reflective structure that reflects incident light from LEDs 102 toward transmissive plate 174.

LEDs 102 can emit different or the same color light, either by direct emission or by phosphor conversion, e.g., where phosphor layers are applied to the LEDs as part of the LED package. The illumination device 100 may use any combination of colored LEDs 102, such as red, green, blue, ultraviolet, amber, or cyan, or the LEDs 102 may all produce the same color light. Some or all of the LEDs 102 may produce white light. In addition, the LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. The light emitted from the illumination device 100 has a desired color when LEDs 102 are used in combination with wavelength converting materials on transmissive plate 174, for example. By tuning the chemical and/or physical (such as thickness and concentration) properties of the wavelength converting materials and the geometric properties of the coatings on the surface of transmissive plate 174, specific color properties of light output by LED based illumination device 100 may be specified, e.g., color point, color temperature, and color rendering index (CRI).

For purposes of this patent document, a wavelength converting material is any single chemical compound or mixture of different chemical compounds that performs a color conversion function, e.g., absorbs an amount of light of one peak wavelength, and in response, emits an amount of light at another peak wavelength.

By way of example, phosphors may be chosen from the set denoted by the following chemical formulas: Y3Al5O12:Ce, (also known as YAG:Ce, or simply YAG) (Y,Gd)3Al5O12:Ce, CaS:Eu, SrS:Eu, SrGa2S4:Eu, Ca3(Sc,Mg)2Si3O12:Ce, Ca3Sc2Si3O12:Ce, Ca3Sc2O4:Ce, Ba3Si6O12N2:Eu, (Sr,Ca)AlSiN3:Eu, CaAlSiN3:Eu, CaAlSi(ON)3:Eu, Ba2SiO4:Eu, Sr2SiO4:Eu, Ca2SiO4:Eu, CaSc2O4:Ce, CaSi2O2N2:Eu, SrSi2O2N2:Eu, BaSi2O2N2:Eu, Ca5(PO4)3Cl:Eu, Ba5(PO4)3Cl:Eu, Cs2CaP2O7, Cs2SrP2O7, Lu3Al5O12:Ce, Ca8Mg(SiO4)4Cl2:Eu, Sr8Mg(SiO4)4Cl2:Eu, La3Si6N11:Ce, Y3Ga5O12:Ce, Gd3Ga5O12:Ce, Tb3Al5O12:Ce, Tb3Ga5O12:Ce, and Lu3Ga5O12:Ce.

In one example, the adjustment of color point of the illumination device may be accomplished by adding or removing wavelength converting material from transmissive plate 174. In one embodiment a red emitting phosphor 179 such as an alkaline earth oxy silicon nitride covers a portion of transmissive plate 174, and a yellow emitting phosphor 178 such as a YAG phosphor covers another portion of transmissive plate 174.

In some embodiments, the phosphors are mixed in a suitable solvent medium with a binder and, optionally, a surfactant and a plasticizer. The resulting mixture is deposited by any of spraying, screen printing, blade coating, jetting, or other suitable means. By choosing the shape and height of the transmissive plate 174, and selecting which portions of transmissive plate 174 will be covered with a particular phosphor or not, and by optimization of the layer thickness and concentration of a phosphor layer on the surfaces, the color point of the light emitted from the device can be tuned as desired.

In one example, a single type of wavelength converting material may be patterned on a portion of transmissive plate 174. By way of example, a red emitting phosphor 179 may be patterned on different areas of the transmissive plate 174 and a yellow emitting phosphor 178 may be patterned on other areas of transmissive plate 174. In some examples, the areas may be physically separated from one another. In some other examples, the areas may be adjacent to one another. The coverage and/or concentrations of the phosphors may be varied to produce different color temperatures. It should be understood that the coverage area of the red and/or the concentrations of the red and yellow phosphors will need to vary to produce the desired color temperatures if the light produced by the LEDs 102 varies. The color performance of the LEDs 102, red phosphor and the yellow phosphor may be measured and modified by any of adding or removing phosphor material based on performance so that the final assembled product produces the desired color temperature.

Transmissive plate 174 may be constructed from a suitable optically transmissive material (e.g., sapphire, quartz, alumina, crown glass, polycarbonate, and other plastics). Transmissive plate 174 is spaced above the light emitting surface of LEDs 102 by a clearance distance. In some embodiments, this is desirable to allow clearance for wire bond connections from the LED package submount to the active area of the LED. In some embodiments, a clearance of one millimeter or less is desirable to allow clearance for wire bond connections. In some other embodiments, a clearance of two hundred microns or less is desirable to enhance light extraction from the LEDs 102.

In some other embodiments, the clearance distance may be determined by the size of the LED 102. For example, the size of the LED 102 may be characterized by the length dimension of any side of a single, square shaped active die area. In some other examples, the size of the LED 102 may be characterized by the length dimension of any side of a rectangular shaped active die area. Some LEDs 102 include many active die areas (e.g., LED arrays). In these examples, the size of the LED 102 may be characterized by either the size of any individual die or by the size of the entire array. In some embodiments, the clearance should be less than the size of the LED 102. In some embodiments, the clearance should be less than twenty percent of the size of the LED 102. In some embodiments, the clearance should be less than five percent of the size of the LED. As the clearance is reduced, light extraction efficiency may be improved, but output beam uniformity may also degrade.

In some other embodiments, it is desirable to attach transmissive plate 174 directly to the surface of the LED 102. In this manner, the direct thermal contact between transmissive plate 174 and LEDs 102 promotes heat dissipation from LEDs 102. In some other embodiments, the space between mounting board 164 and transmissive plate 174 may be filled with a solid encapsulate material. By way of example, silicone may be used to fill the space. In some other embodiments, the space may be filled with a fluid to promote heat extraction from LEDs 102.

In the embodiment illustrated in FIG. 5, the surface of patterned transmissive plate 174 facing LEDs 102 is coupled to LEDs 102 by an amount of flexible, optically translucent encapsulating material 177. By way of non-limiting example, the flexible, optically translucent encapsulating material 177 may include an adhesive, an optically clear silicone, a silicone loaded with reflective particles (e.g., titanium dioxide (TiO2), zinc oxide (ZnO), and barium sulfate (BaSO4) particles, or a combination of these materials), a silicone loaded with a wavelength converting material (e.g., phosphor particles), a sintered PTFE material, etc. Such material may be applied to couple transmissive plate 174 to LEDs 102 in any of the embodiments described herein.

In some embodiments, multiple, stacked transmissive layers or plates are employed. Each transmissive plate includes different wavelength converting materials. For example, a transmissive plate including a wavelength converting material may be placed over another transmissive plate including a different wavelength converting material. In this manner, the color point of light emitted from LED based illumination device 100 may be tuned by replacing the different transmissive plates independently to achieve a desired color point. In some embodiments, the different transmissive plates may be placed in contact with each other to promote light extraction. In some other embodiments, the different transmissive plates may be separated by a distance to promote cooling of the transmissive layers. For example, airflow may by introduced through the space to cool the transmissive layers.

The mounting board 164 provides electrical connections to the attached LEDs 102 to a power supply (not shown). In one embodiment, the LEDs 102 are packaged LEDs, such as the Luxeon Rebel manufactured by Philips Lumileds Lighting. Other types of packaged LEDs may also be used, such as those manufactured by OSRAM (Ostar package), Luminus Devices (USA), Cree (USA), Nichia (Japan), or Tridonic (Austria). As defined herein, a packaged LED is an assembly of one or more LED die that contains electrical connections, such as wire bond connections or stud bumps, and possibly includes an optical element and thermal, mechanical, and electrical interfaces. The LEDs 102 may include a lens over the LED chips. Alternatively, LEDs without a lens may be used. LEDs without lenses may include protective layers, which may include phosphors. The phosphors can be applied as a dispersion in a binder, or applied as a separate plate. Each LED 102 includes at least one LED chip or die, which may be mounted on a submount. The LED chip typically has a size about 1 mm by 1 mm by 0.5 mm, but these dimensions may vary. In some embodiments, the LEDs 102 may include multiple chips. The multiple chips can emit light of similar or different colors, e.g., red, green, and blue. The LEDs 102 may emit polarized light or non-polarized light and LED based illumination device 100 may use any combination of polarized or non-polarized LEDs. In some embodiments, LEDs 102 emit either blue or UV light because of the efficiency of LEDs emitting in these wavelength ranges. In addition, different phosphor layers may be applied on different chips on the same submount. The submount may be ceramic or other appropriate material. The submount typically includes electrical contact pads on a bottom surface that are coupled to contacts on the mounting board 164. Alternatively, electrical bond wires may be used to electrically connect the chips to a mounting board. Along with electrical contact pads, the LEDs 102 may include thermal contact areas on the bottom surface of the submount through which heat generated by the LED chips can be extracted. The thermal contact areas are coupled to heat spreading layers on the mounting board 164. Heat spreading layers may be disposed on any of the top, bottom, or intermediate layers of mounting board 164. Heat spreading layers may be connected by vias that connect any of the top, bottom, and intermediate heat spreading layers.

In some embodiments, the mounting board 164 conducts heat generated by the LEDs 102 to the sides of the mounting board 164 and the bottom of the mounting board 164. In one example, the bottom of mounting board 164 may be thermally coupled to a heat sink 120 (shown in FIGS. 1-3) via mounting base 101. In other examples, mounting board 164 may be directly coupled to a heat sink, or a lighting fixture and/or other mechanisms to dissipate the heat, such as a fan. In some embodiments, the mounting board 164 conducts heat to a heat sink thermally coupled to the top of the mounting board 164. Mounting board 164 may be an FR4 board, e.g., that is 0.5 mm thick, with relatively thick copper layers, e.g., 30 μm to 100 μm, on the top and bottom surfaces that serve as thermal contact areas. In other examples, the mounting board 164 may be a metal core printed circuit board (PCB) or a ceramic submount with appropriate electrical connections. Other types of boards may be used, such as those made of alumina (aluminum oxide in ceramic form), or aluminum nitride (also in ceramic form).

Mounting board 164 includes electrical pads to which the electrical pads on the LEDs 102 are connected. The electrical pads are electrically connected by a metal, e.g., copper, trace to a contact, to which a wire, bridge or other external electrical source is connected. In some embodiments, the electrical pads may be vias through the mounting board 164 and the electrical connection is made on the opposite side, i.e., the bottom, of the board. Mounting board 164, as illustrated, is rectangular in dimension. LEDs 102 mounted to mounting board 164 may be arranged in different configurations on rectangular mounting board 164. In one example LEDs 102 are aligned in rows extending in the length dimension and in columns extending in the width dimension of mounting board 164. In another example, LEDs 102 are arranged in a hexagonally closely packed structure. In such an arrangement each LED is equidistant from each of its immediate neighbors. Such an arrangement is desirable to increase the uniformity and efficiency of emitted light.

In some embodiments, an average current supplied to one or more LEDs of an LED based illumination device is controlled by periodically switching a current supplied to the LED(s) from a high state to a low state over a switching period. In one aspect, both the duration of the switching period and a ratio of time in the high state to time in the low state over the switching period are adjusted to transition the average current supplied to the LED based illumination device from one average current level to another average current level. In this manner, the average luminous flux emitted from the LED based illumination device is transitioned between two different levels in a controlled manner. In addition, the average current supplied to the same LED(s) is controlled by adjusting the current supplied to the LED during the high state.

In some embodiments, the average luminous flux emitted from the LED based illumination device is varied from one value to another by a combination of adjusting the current supplied to the LED during the high state, adjusting the duration of the switching period, and adjusting the ratio of time in the high state to time in the low state over the switching period.

In some other embodiments, the average luminous flux emitted from the LED based illumination device is varied from one value to a second value by adjusting the current supplied to the LED during the high state, and the average luminous flux emitted from the LED based illumination device is varied from the second value to a third value by adjusting the duration of the switching period and the ratio of time in the high state to time in the low state over the switching period.

Figure 6:
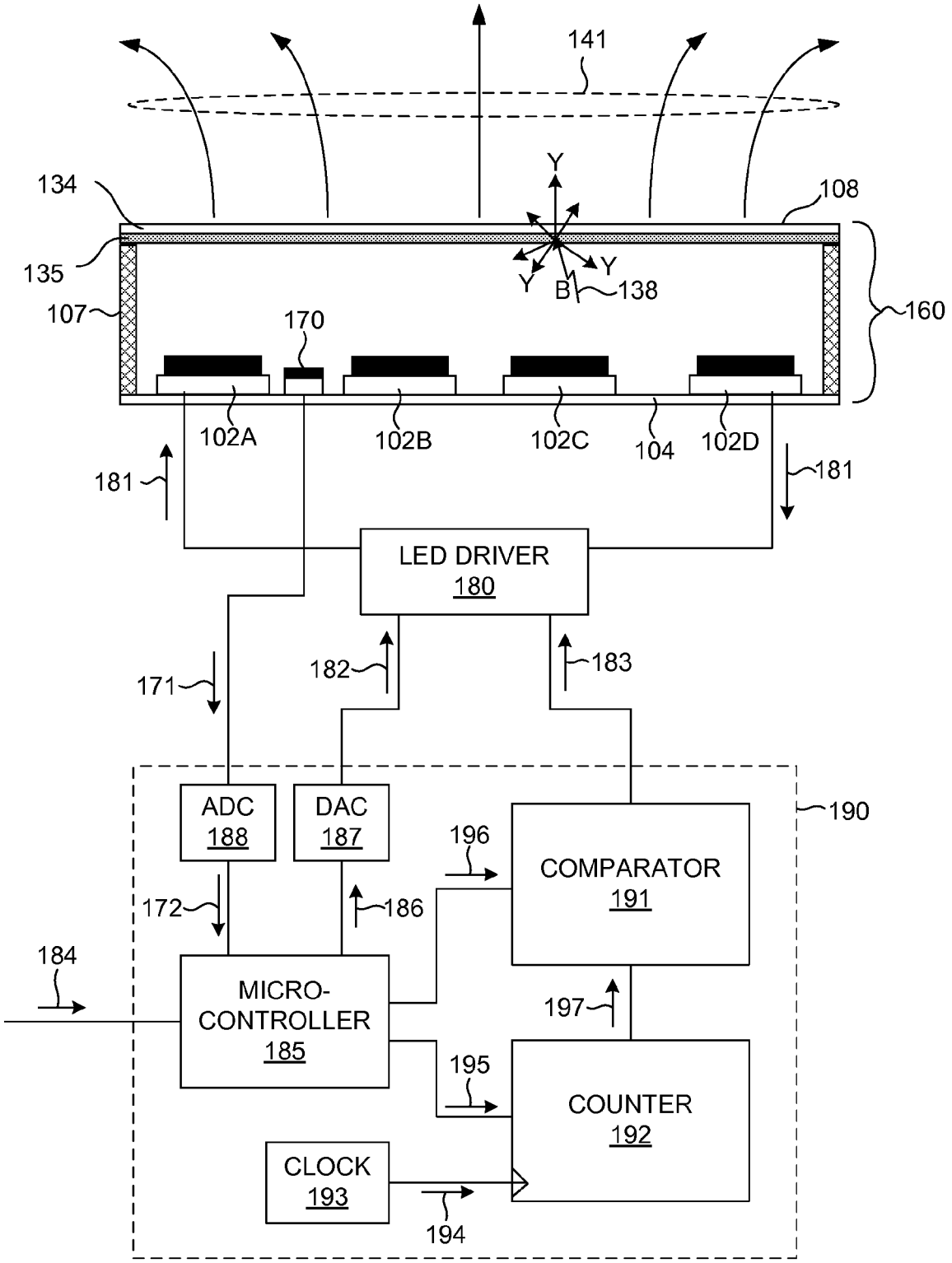
FIG. 6 is illustrative of a cross-sectional, side view of an LED based light engine including an LED driver and a dimming control engine.

FIG. 6 is illustrative of a cross-sectional, side view of an LED based light engine 160 in one embodiment. As illustrated, LED based light engine 160 includes a plurality of LEDs 102A-102D, a sidewall 107 and an output window 108. Output window 108 includes a transmissive layer 134 and a color converting layer 135. Color converting layer 135 includes one or more wavelength converting materials with different color conversion properties. The LEDs 102A-102D of LED based light engine 160 emit light that is directed toward transmissive layer 134 and color converting layer 135. Light is mixed and color converted and the resulting combined light 141 is emitted by LED based illumination module 100. For example, as illustrated in FIG. 6, a blue photon 138 emitted from LEDs 102A-102D interacts with a yellow-emitting phosphor particle in color converting layer 135. A portion of the emitted yellow light passes through transmissive layer 134, and is emitted from the LED based light engine 160 as part of combined light 141.

LED driver 180 is coupled to LEDs 102A-102*d* and supplies current 181 to the LEDs in response to command signals 182 and 183. In one embodiment, LED driver 180 is an LED driver model number 16832 manufactured by Maxim Integrated Products, Inc., Sunnyvale, Calif., USA. Such an LED driver is configured to adjust the value of the output current 181 based on the analog signal 182, and is further configured to adjust the output current 181 based on digital signal 183. In this manner, LED driver 180 controls the luminous flux emitted from LED based light engine 160 based on analog signal 182 and digital signal 183. In some embodiments, LED driver 180 is a direct current to direct current power converter. In other words, LED driver 180 receives a DC voltage power signal supplied by a constant voltage power source, and generates output current 181 based on any of command signals 182 and 183. In some other embodiments, LED driver 180 is an alternating current to direct current power converter. In other words, LED driver 180 receives an AC voltage power signal supplied by an AC voltage power source, and generates output current 181 based on any of command signals 182 and 183. If desired, the method discussed herein may be used with AC LEDs as well.

Dimming control engine 190 is coupled to LED driver 180 and is configured to communicate analog signal 182 and digital signal 183 to LED driver 180. In the embodiment depicted in FIG. 6, digital dimming control engine 190 includes microcontroller 185, digital to analog converter 187, clock 193, counter circuitry 192, and comparator 191. In some embodiments, dimming control engine 190 is configured as an integrated circuit, such as the STM8L microcontroller manufactured by STMicroelectronics, Geneva, Switzerland. In some embodiments, any of LED driver 180 and dimming control engine 190 are implemented as part of EIM 122 depicted in FIG. 4. In these embodiments, any of LED driver 180 and dimming control engine 190 are implemented as part of an mechanically and electrically integrated LED based illumination device (e.g., LED based illumination device 100). However, in general, any of LED driver 180 and dimming control engine 190 may be implemented as part of an electronic assembly that is physically separated from an LED based light engine (e.g., LED based light engine 160) and electrically coupled to the LED based light engine by typical electrical connectors.

In one embodiment, microcontroller 185 receives a digital signal 184 indicative of a desired luminous flux output of LED based light engine 160. In one example, digital signal 184 is a Digital Addressable Lighting Interface (DALI) command signal. In general digital signal 184 may be any digital signal indicative of a desired light output level of LED based light engine 160.

In other embodiments, dimming control engine 190 receives an analog signal indicative of a desired luminous flux output of LED based light engine 160. In these embodiments, the analog signal is received by an analog to digital converter (not shown). The analog to digital converter generates a representative digital signal that is communicated to microcontroller 185.

In one embodiment, microcontroller generates digital signal 186, preload value signal 195, and threshold value signal 196 based on digital signal 184. In one example, microcontroller 185 receives digital signal 184 indicating that the light output of LED based light engine 160 should be controlled to 50% of its rated light output. In response, microcontroller 185 generates digital signal 186 that is converted to analog signal 182 by digital to analog converter 187. LED driver 180 receives analog signal 182 and reduces the current 181 supplied to LEDs 102A-102D to 50% of the current normally supplied to LEDs 102A-102D when LED based light engine 160 is operating at its rated light output level. Microcontroller 185 also generates a preload value signal 195 and a threshold value signal 196 such that digital signal 183 is maintained at a high state (i.e., digital high value) at all times. In this mode of operation, the light output of LED based light engine 160 is changed by the value of analog signal 182.

In one embodiment, the light output of LED based light engine 160 is determined by the value of analog signal 182 from operation at its rated light output to operation at 30% of its rated light output. Below 30%, microcontroller controls the light output of LED based light engine 160 based on the value of digital signal 183.

In one example, microcontroller 185 receives a value of digital signal 184 indicating that the light output of LED based light engine 160 should be controlled to 20% of its rated light output. In response, microcontroller 185 generates digital signal 186 that is converted to analog signal 182 by digital to analog converter 187. Analog signal 182 is set to a value to reduce the current 181 supplied to LEDs 102A-102D to 30% of the current normally supplied to LEDs 102A-102D when LED based light engine 160 is operating at its rated light output level. In addition, microcontroller 185 also generates a preload value signal 195 and a threshold value signal 196 such that digital signal 183 is periodically switched from a high state to a low state in a proportion that leads to an additional reduction in light output to realize an operation of LED based illumination 160 at 20% of its rated light output.

Figure 7:
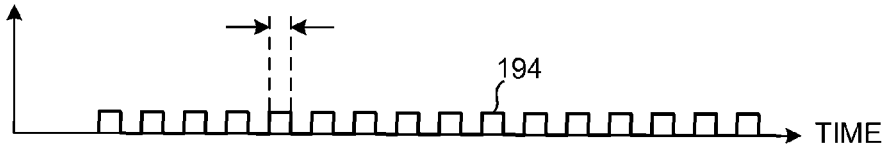
FIG. 7 illustrates an exemplary clock signal.
Figure 8:
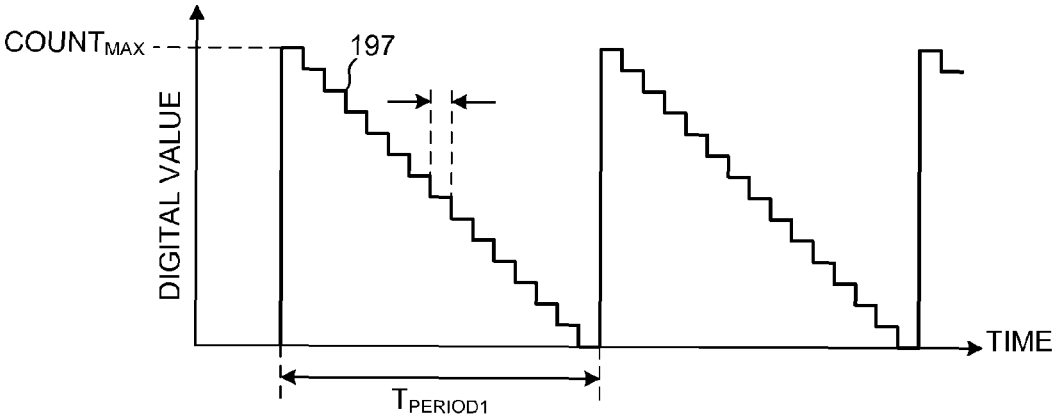
FIG. 8 illustrates a counter signal when a counter receives a zero valued preload signal.

As depicted in FIG. 6, clock 193 generates a clock signal 194. FIG. 7 illustrates an exemplary clock signal 194. As depicted in FIG. 7, clock signal 194 is a train of digital pulses repeating at a rate determined by the clock frequency. Clock signal 194 toggles between a digital high and digital low value. Counter 192 receives the clock signal 194 and generates counter signal 197. FIG. 8 illustrates a counter signal 197 when counter 192 receives a zero valued preload signal. As depicted in FIG. 8, the value of digital signal 197 steps down at each clock cycle until a zero value is reached. For example, a 16-bit counter would step between 65,536 digital values to reach the zero value. At this point, counter 192 resets and the value of digital signal 197 resets to a maximum count value, countmax. The duration of each cycle of counter signal 197 is Tperiod1. In this example, Tperiod1, is the time it takes to step from countmax to the zero value.

Figure 9:
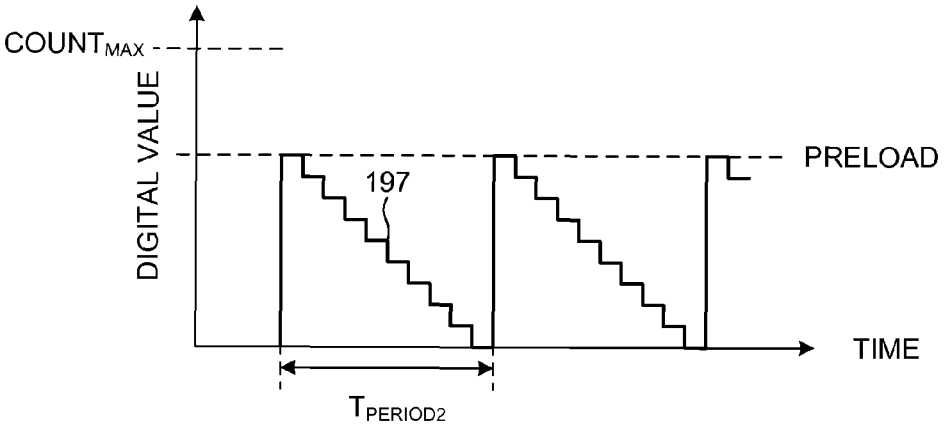
FIG. 9 illustrates an exemplary counter signal when the counter receives a non-zero valued preload signal.

FIG. 9 illustrates an exemplary counter signal 197 when counter 192 receives a non-zero valued preload signal. As depicted in FIG. 9, the value of digital signal 197 steps down at each clock cycle from the preload value until a zero value is reached. At this point, counter 192 resets and the value of digital signal 197 resets to the preload value, which is less than the maximum count value, countmax. In this example, the duration of each cycle of counter signal 197 is Tperiod2, and Tperiod2, is the time it takes to step from the preload value to the zero value and reset to the preload value. Thus, it follows that the duration of the switching period of counter signal 197 is adjusted by microcontroller 185 by changing the value of the preload signal 195.

Figure 10:
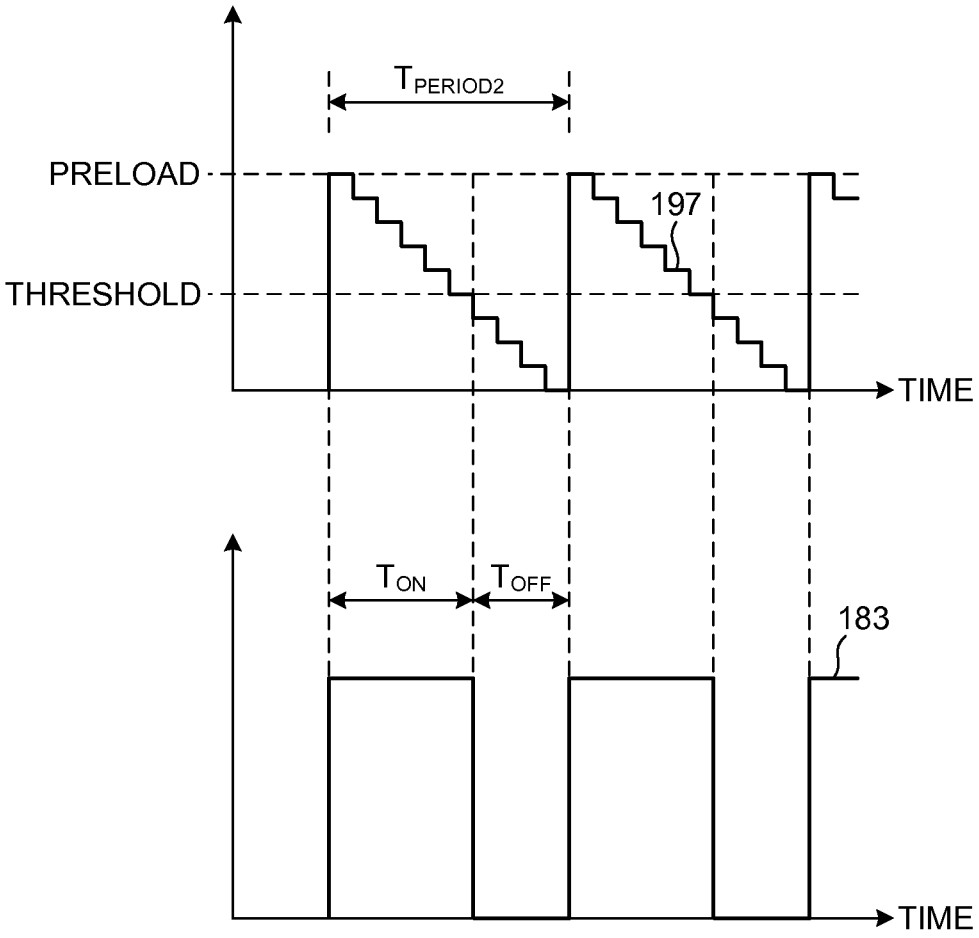
FIG. 10 illustrates a digital signal generated by a comparator in response to a counter signal for a given preload value a received threshold value signal.

As depicted in FIG. 6, comparator 191 receives counter signal 197 and generates digital signal 183 based at least in part on the value of threshold value signal 196. FIG. 10 illustrates counter signal 197 for a given preload value as described with reference to FIG. 9. Comparator 191 compares the value of counter signal 197 with the value of threshold value signal 196. If the value of counter signal 197 is greater than or equal to the value of the threshold value signal 196, comparator 191 generates a digital high value. If the value of counter signal 197 is less than the value of the threshold value signal 196, comparator 191 generates a digital low value. In this example, the duration of time that digital signal 183 is in a digital high state is Ton, and the duration of time that digital signal 183 is in a digital low state is Toff. Thus, it follows that the ratio of time in the high state, Ton, to time in the low state, Toff, is adjusted by microcontroller 185 by changing the value of the threshold value signal 196.

Counter 192 is described as a down counter with specific reference to FIGS. 8-10. However, in other examples, counter 192 may be implemented as an up counter, an up-down counter, or a down-up counter in an analogous manner.

In one aspect, microcontroller 185 changes both the preload value and threshold value to reduce the luminous output of LED based light engine 160 to less than 0.1% of its rated luminous output, in other words, the average current level supplied to the LED based illumination device is less than 0.1 percent of a maximum rated average current of the LED based illumination device. In some embodiments, microcontroller 185 changes both the preload value and threshold value to reduce the luminous output of LED based light engine 160 to less than 0.01% of its rated luminous output.

In general, microcontroller 185 can be configured to change both the preload value and threshold value in any suitable manner to reduce the luminous output of LED based light engine 160. For example, in one implementation, duration of the switching period and the ratio of the time in the high state to the time in the low state may both be adjusted in a same digital dimming step. In some examples, the duration of the switching period may be monotonically increased at each digital step as the luminous output of LED based light engine 160 is decreased. At the same time, the ratio of time in the high state to time in the low state is adjusted to provide smooth, evenly spaced transitions between each digital step.

In some other examples, the ratio of time in the high state to time in the low state is monotonically decreased at each digital step as the luminous output of LED based light engine 160 is decreased. At the same time, the duration of the switching period is adjusted to provide smooth, evenly spaced transitions between each digital step.

In some other examples, both the ratio of time in the high state to time in the low state and the duration of the switching period are independently adjusted as the luminous output of LED based light engine 160 is decreased. The values are chosen to provide smooth, evenly spaced transitions between each digital step. In some examples, the ratio of time in the high state to time in the low state is adjusted while the duration of the switching period is held constant as the luminous output of LED based light engine 160 is adjusted from a first level to a second level, and the duration of the switching period is adjusted while the ratio of time in the high state to time in the low state is held constant as the luminous output of LED based light engine 160 is adjusted from the second level to a third level. In this manner, the transition in luminous output of LED based light engine 160 may include portions that include only changes in the ratio of time in the high state to time in the low state and other portions that include only changes in the duration of the switching period.

In some examples, each digital step (i.e., each incremental change in either, or both, the ratio of time in the high state to time in the low state and the duration of the switching period) results in a change in lumen output of the LED based light engine 160 of less than 0.1%.

In some examples, each digital step (i.e., each incremental change in either, or both, the ratio of time in the high state to time in the low state and the duration of the switching period) results in a change in lumen output of the LED based light engine 160 of less than 0.03%.

In another aspect, an average current supplied to one or more LEDs of an LED based illumination device is controlled by stretching the transition time near the desired luminous output value.

Figure 12:
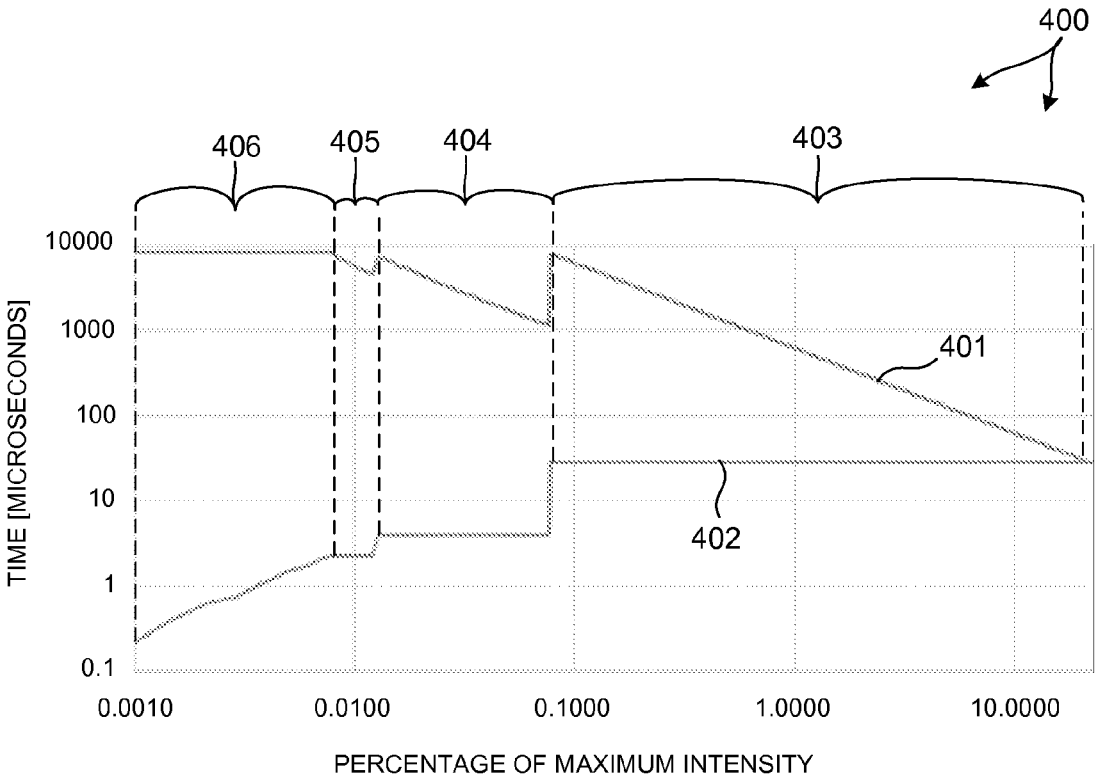
FIG. 12 depicts a plot of the duration of the switching period and the duration of the pulse (i.e., time in the high state) within each switching period for each dimming step within a range of 0.001% and 23% of maximum intensity.

By way of example, a constant current reduction (CCR) dimming scheme may be used to reduce the lumen output of the LED based light engine 160 to a desired percentage, e.g., 23-25%, after which microcontroller 185 may adjust one or both of the duration of the switching period and the duration of the pulse (i.e., time in the high state) within each switching period at each digital dimming step to further reduce the luminous output of LED based light engine 160. FIG. 12 depicts a plot 400 of the duration of the switching period 401 and the duration of the pulse 402 for each dimming step within a range of 0.001% and 23% of maximum intensity. In this range, microcontroller 185 adjusts one or both the duration of the switching period and the duration of the pulse at each digital dimming step. In this example, dimming down to 23% of maximum intensity is achieved by CCR dimming. A further reduction in average light level is achieved by increasing the duration of the switching period from approximately 30 microseconds while maintaining the duration of the pulse constant within the range of dimming steps noted by reference numeral 403 in FIG. 12. The lumen output scales inversely with the duration of the switching period for a constant duration of the pulse, and thus, the duration of the switching period may be adjusted (e.g., increased at each step) to produce a lumen output of 0.08% at a switching period of approximately 8,333 microseconds.

A reduction in lumen output below 0.08% is achieved by adjusting the duration of the switching period to approximately 1,111 microseconds while adjusting duration of the pulse to maintain the same lumen output. This digital dimming step is illustrated at the transition between the digital dimming steps noted by reference numerals 403 and 404 in FIG. 12. To further reduce the lumen output, e.g., down to 0.011%, the duration of the switching period is again adjusted (e.g., increased at each step) while maintaining the duration of the pulse constant within the range of dimming steps noted by reference numeral 404 in FIG. 12. A lumen output of approximately 0.011% is achieved at a switching period of approximately 8,333 microseconds at the duration of the pulse depicted in range 404. A reduction in lumen output below 0.011% is achieved by adjusting the duration of the switching period to approximately 4,545 microseconds while adjusting the duration of the pulse to maintain the same lumen output. This digital dimming step is illustrated at the transition between the digital dimming steps noted by reference numerals 404 and 405 in FIG. 12. To further reduce the lumen output, e.g., down to 0.006%, the duration of the switching period is again adjusted (e.g., increased at each step) while maintaining the duration of the pulse constant within the range of dimming steps noted by reference numeral 405 in FIG. 12. A lumen output of approximately 0.006% is achieved at a switching period of approximately 8,196 microseconds at the duration of the pulse depicted in range 405. To produce a lumen output below approximately 0.006%, the duration of the switching period may be held constant at approximately 8,196 microseconds and the duration of the pulse is adjusted until the light is off as depicted in the range of dimming steps noted by reference numeral 406 in FIG. 12. It should be understood that the specific pulse durations, switching periods, and lumen output levels are provided merely for the sake of example, and other pulse durations, switching periods, and lumen output levels may be used. Moreover, while the duration of the switching period is described as being decreased twice, e.g., at lumen levels of 0.08% and 0.011%, additional or fewer decreases in the duration of the switching period may be used.

Typical 0-10V analog controllers receive a signal indicative of a desired light output, and then generate a 0-10V analog control signal that steadily transitions from the current light output to the desired light output over a fixed transition time (e.g., 400 milliseconds). This approach leads to undesireable transitions in light output when the signal indicative of the desired light output is noisy. Typical 0-10V analog controllers may interpret the noise as a series of changes in the desired light output. The resulting 0-10V control signal is a series of transitions from one light output to another.

In one example, the 0-10V analog control signal is received by a dimming control engine, such as dimming control engine 190 depicted in FIG. 6. As described hereinbefore, dimming control engine 190 may be configured with an analog to digital converter (not shown) to convert the 0-10V analog control signal to a digital value that may be received by microcontroller 185. Microcontroller 185 determines whether the 0-10V analog control signal value is within a predetermined percentage of the desired value (i.e., the control signal is within 5% of its target value). If the value of the 0-10V analog signal is not within the predetermined percentage of the target value, microprocessor 185 passes through the analog value. In other words, microprocessor 185 generates a digital value that is converted by digital to analog converter 187 into a value of analog signal 182 that is approximately the same as the received value of the 0-10V analog signal. However, if the value of the 0-10V analog signal is within the predetermined percentage of the target value, microprocessor 185 stretches, or extends, the transition time from the current value to the target value to decrease the effect of noise reflected in the 0-10V analog control signal. In some examples, a 400 millisecond transition time is utilized until the commanded light output reaches 99% of the target value, and then the transition time is extended for an additional second to reach the target value.

In yet another aspect, an ambient light level is sensed by a flux sensor included in an LED based light engine during a time period when current supplied to the LED based light engine is at a zero state. In addition, the dimming level is adjusted based on the measured ambient light level.

FIG. 6 is illustrative of LED based light engine 160 in a further embodiment. As illustrated, LED based light engine 160 includes a flux sensor 170 mounted to the LED mounting board 104. Flux sensor 170 is coupled to analog to digital converter 188 of dimming control engine 190. Flux sensor 170 communicates a signal 171 indicative of the flux level sensed by sensor 170 to ADC 188. ADC 188 converts the analog signal 171 to a digital signal 172. Microcontroller 185 is configured to read in the value of digital signal 172 while LED driver 180 is not supplying current to LEDs 102A-102D. In one example, microcontroller 185 reads in the value of digital signal 172 during a period of time when digital signal 183 is at a zero value (e.g., digital low state). In this manner, the flux sensed by flux sensor 170 is indicative of the ambient light environment as seen by LED based light engine 160 while LED based light engine 160 is not emitting light.

Figure 11:
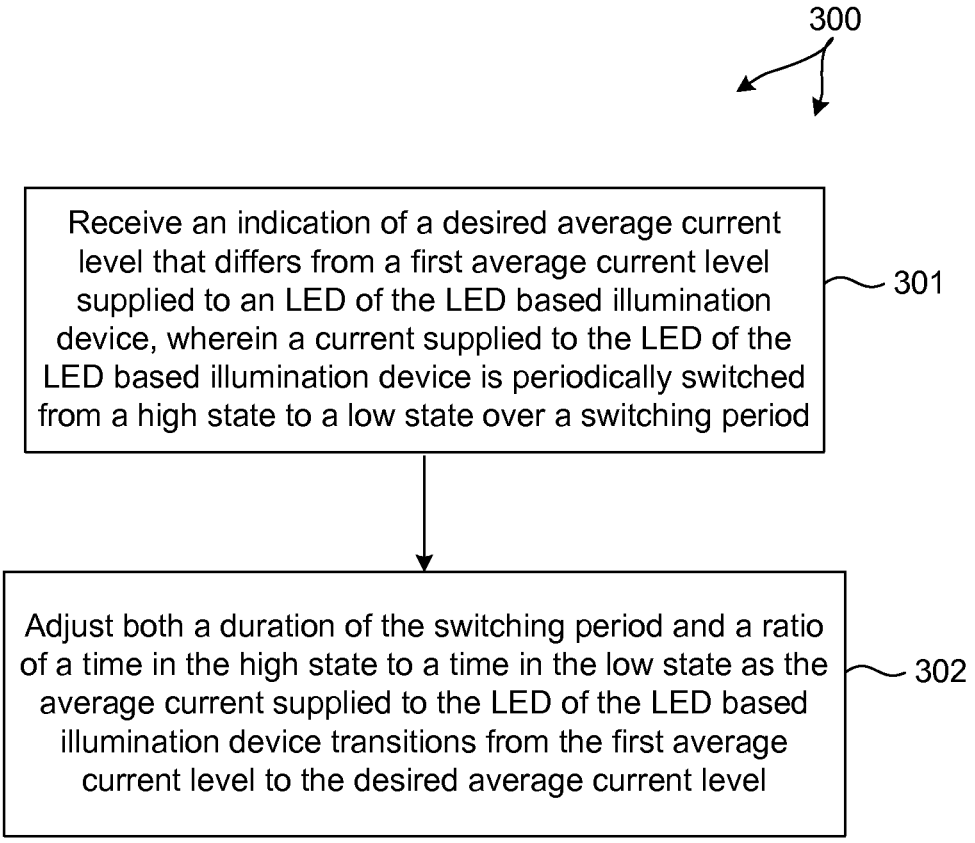
FIG. 11 is a flow chart of a method of controlling an average current supplied to an LED based illumination device.

FIG. 11 is a flow chart of a method of controlling an average current supplied to an LED based illumination device. As illustrated, an indication of a desired average current level that differs from a first average current level supplied to an LED of the LED based illumination device is received, wherein a current supplied to the LED of the LED based illumination device is periodically switched from a high state to a low state over a switching period (301). Both a duration of the switching period and a ratio of a time in the high state to a time in the low state is adjusted as the average current supplied to the LED of the LED based illumination device transitions from the first average current level to the desired average current level (302).

Although certain specific embodiments are described above for instructional purposes, the teachings of this patent document have general applicability and are not limited to the specific embodiments described above. For example, the particular configuration of dimming control engine 190 is provided by way of non-limiting example. Many other configurations may be contemplated to independently control both the ratio of time in a high state to time in a low state and the duration of a switching period. In another example, LED based illumination module 100 is depicted in FIGS. 1-3 as a part of a luminaire 150. As illustrated in FIG. 3, LED based illumination module 100 may be a part of a replacement lamp or retrofit lamp. But, in another embodiment, LED based illumination module 100 may be shaped as a replacement lamp or retrofit lamp and be considered as such. Accordingly, various modifications, adaptations, and combinations of various features of the described embodiments can be practiced without departing from the scope of the invention as set forth in the claims.

What is claimed is:

1. A method of controlling an average current supplied to an LED based illumination device, comprising:

receiving an indication of a desired average current level that differs from a first average current level supplied to a light emitting diode (LED) of the LED based illumination device;

generating a digital control signal with a comparator circuit for periodically switching a current supplied to the LED of the LED based illumination device from a high state to a low state over a switching period while generating an analog control signal with a digital to analog conversion circuit for adjusting a value of the current supplied to the LED during the high state, adjusting a duration of the switching period and adjusting a ratio of a time in the high state to a time in the low state by adjusting with the comparator circuit both the time in the high state and the time in the low state, as the average current supplied to the LED of the LED based illumination device transitions from the first average current level to the desired average current level; and supplying the current to the LED of the LED based illumination device based on the analog control signal and the digital control signal.

2. The method of controlling the average current supplied to the LED based illumination device of claim 1, wherein the switching period is determined by a number of clock pulses, and wherein the ratio of the time in the high state to the time in the low state is determined by a threshold value.

3. The method of controlling the average current supplied to the LED based illumination device of claim 1, wherein the duration of the switching period and the ratio of the time in the high state to the time in the low state are both adjusted in a same digital dimming step.

4. The method of controlling the average current supplied to the LED based illumination device of claim 1, wherein each step of the transition from the first average current level to the desired average current level changes a lumen output of the LED based illumination device by less than 0.03%.

5. The method of controlling the average current supplied to the LED based illumination device of claim 1, wherein the desired average current level supplied to the LED based illumination device is less than 0.1 percent of a maximum rated average current of the LED based illumination device.

6. The method of controlling the average current supplied to the LED based illumination device of claim 1, wherein the switching period is changed monotonically as the average current supplied to the LED based illumination device transitions from the first average current level to the desired average current level.

7. The method of controlling the average current supplied to the LED based illumination device of claim 1, wherein the ratio of the time in the high state to the time in the low state is changed monotonically as the average current supplied to the LED based illumination device transitions from the first average current level to the desired average current level.

8. The method of controlling the average current supplied to the LED based illumination device of claim 1, wherein the switching period is changed by changing a preload value of a counter circuit, and wherein the comparator circuit receives a counter signal from the counter circuit based on the preload value and the comparator circuit compares a threshold value to the counter signal to adjust both the duration of the switching period and the ratio of the time in the high state to the time in the low state.

9. The method of controlling the average current supplied to the LED based illumination device of claim 1, further comprising:

sensing an ambient light level during a time period when the current supplied to the LED based illumination device is at a zero state.

10. An LED based illumination device, comprising:

at least one light emitting diode (LED);

a LED driver coupled to the LED, the LED driver configured to supply a current to the LED based on an analog control signal and a digital control signal received by the LED driver; and a dimming control engine configured to communicate the analog control signal and the digital control signal to the LED driver, the dimming control engine, comprising:

an amount of electronic circuitry comprising a comparator circuit configured to generate the digital control signal that causes the LED driver to periodically switch the current supplied to the LED between a high state and a low state over a switching period and a digital to analog converter configured to generate the analog control signal that causes the LED driver to change a value of the current supplied to the LED during the high state, and wherein both a duration of the switching period and a ratio of a time in the high state to a time in the low state are adjusted by the comparator circuit, wherein the ratio of the time in the high state and the time in the low state is adjusted by adjusting both the time in the high state and the time in the low state, as an average current supplied to the LED based illumination device transitions from a first average current level to a desired average current level.

11. The LED based illumination device of claim 10, further comprising:

a flux sensor disposed within the LED based illumination device, wherein a flux value sensed by the flux sensor is read by the dimming control engine during a time period when the current supplied to the LED is at a zero state.

12. The LED based illumination device of claim 10, wherein each step of the transition from the first average current level to the desired average current level changes a lumen output of the LED based illumination device by less than 0.03%.

13. The LED based illumination device of claim 10, wherein the desired average current level supplied to the LED based illumination device is less than 0.1 percent of a maximum rated average current of the LED based illumination device.

14. A dimming control engine, comprising:

a microprocessor configured to receive an indication of a desired average current level supplied to a light emitting diode (LED) based illumination device;

an amount of electronic circuitry comprising a comparator circuit configured to generate a digital control signal that periodically switches a current supplied to the LED based illumination device between a high state and a low state and a digital to analog converter configured to generate an analog control signal to cause a change in a value of the current supplied to the LED based illumination device during the high state, and wherein both a duration of a switching period and a ratio of a time in the high state to a time in the low state are adjusted by the comparator circuit, wherein the ratio of the time in the high state and the time in the low state is adjusted by adjusting both the time in the high state and the time in the low state, as an average current supplied to the LED based illumination device transitions from a first average current level to the desired average current level.

15. The dimming control engine of claim 14, wherein each step of the transition from the first average current level to the desired average current level changes a lumen output of the LED based illumination device by less than 0.03%.

16. The dimming control engine of claim 14, wherein the desired average current level supplied to the LED based illumination device is less than 0.1 percent of a maximum rated average current of the LED based illumination device.

* * * * *